United States Patent [19]

Kabe et al.

[11] Patent Number: 4,701,199

[45] Date of Patent: Oct. 20, 1987

[54] CHEMICAL HEAT PUMP SYSTEM

[76] Inventors: Toshiaki Kabe, 3424 Honmachida, Machida-shi, Tokyo-to; Hideo Kameyama, 5-2-102, Honcho 1-chome, Koganei-shi, Tokyo-to, both of Japan

[21] Appl. No.: 855,457

[22] Filed: Apr. 24, 1986

[30] Foreign Application Priority Data

May 1, 1985 [JP] Japan ..... 60-92187

[51] Int. Cl.[4] ..... F25D 5/00

[52] U.S. Cl. ..... 62/4; 62/114; 165/104.12

[58] Field of Search ..... 62/114, 505, 511, 510, 62/500, 4, 115–117; 165/104.12 X

[56] References Cited

U.S. PATENT DOCUMENTS 2,938,362 5/1960 Schwind ..... 62/114 X
3,159,008 12/1964 Nebgen ..... 62/114 X
3,277,659 10/1966 Sylvan et al. ..... 62/114
4,161,210 7/1979 Reid et al. ..... 62/4 X
4,251,247 2/1981 Gauberthier et al. ..... 62/114 X
4,283,211 8/1981 Ehrlich et al. ..... 62/4

*Primary Examiner*—Lloyd L. King

[57] ABSTRACT

This invention discloses an improved chemical heat pump system utilizing a reversible decomposition reaction-addition reaction system, wherein a gaseous product is generated by said decomposition reaction. The present system can realize a large coefficient of performance (C.O.P) by introducing into the heat pump system, a separation stage (to separate the decomposition reaction mixture circulating in the system into a gas phase and liquid phase) and then compressing each gas phase and liquid phase separately. By choice of the chemical reaction system, the present system is able to meet various requirements concerning temperatures of the lower heat source and the higher heat source. The present system is superior to conventional systems in reducing attrition of the heat pump apparatus.

8 Claims, 5 Drawing Figures

CHEMICAL HEAT PUMP SYSTEM

BACKGROUND OF THE INVENTION

1. Field of the Invention

This invention relates to chemical heat pump system utilizing reversible decomposition-addition reaction. More particularly this invention relates to chemical heat pump system of improved efficiency.

2. Prior Art of the Invention

Recently, heat pump were watched with keen interest since they are useful to save energy because they can recover much energy from lower heat sources using small amounts of energy. In this case both mechanical energy and chemical energy can be used as said small amount of energy.

In a case of so called compression type heat pump using mechanical energy, not only is the so called coefficient of performance (C.O.P.) limited but also temperatures of lower heat source and temperatures of higher heat source (from which energy is recovered) are limited since there are limitations on safety or heat stability of the heating medium and on mechanical strength of the system.

On the other hand, in a chemical heat pump utilizing reversible endothermic and exothermic reactions, the temperature ranges of the lower heat source and the higher heat source in the chemical heat pump system can be broadened, by selecting the raction system.

For example, when a reversible reaction, (e.g. a secondary alcohol decomposing to a ketone and a hydrogen) is utilized, the temperature of the lower heat source is about 55° C.–80° C. and that of the higher heat source is about 160° C.–230° C. (e.g. "Arts for Heat Accumulation and Heat Increase" 117 pages, (1985), Chemical Engineering Symposium Series 8, Edited by Chemical Engineering Association). On the other hand when a reversible reaction between a benzene and a cyclohexane—dehydrogenation and addition of the hydrogen—is utilized, the temperature of the lower heat source can be more than 200° C. and the temperature of the higher heat source may to be from about 300° C. to about 400° C. (ibid., pg. 123).

Generally, a dehydrogenation reaction is an endothermic reaction and a hydrogenation reaction is an exothermic reaction. Therefore, by carring out these reactions in separate reaction vessels, each vessel becomes an exothermic reaction vessel or an endothermic reaction vessel. Namely, by circulating a reactant between the exothermic reaction vessel and endothermic reaction vessel, energy can be recovered through a heat exchanger provided between said exothermic reaction vessel and endothermic reaction vessel. Using this principle alone, however, the efficiency as heat pump system is insufficient. This is because the hydrogenation reaction is negligible when the temperature of the reaction vessel is to high—this fact is consistent with Le Chatelier's principle. Therefore, it is necessary to shift the equiribium by carring out the hydrogenation reaction under compression.

As a new method to solve the above mentioned problem, we have already disclosed a chemical heat pump system utilizing a mixed solution for the reaction system of the hydrogenation—dehydrogenation reversible reaction, in which a hydrogen absorbing alloy was dispersed to make slurry (Japanese Patent Application No. 47350/'85. This system is called "the conventional system" in this specification). However, this system has points to be improved since (1) the hydrogen absorbing alloy is very expensive, (2) a passage of the alloy through the system causes damage because the abrasive slurry is always circulated in the system and shortens the lifetime of the system, (3) the hydrogen absorbing alloy becomes to catalyst to lower the temperature of the higher heat source by lowering the reaction temperature of the exothermic reaction.

We completed this invention as a result of our earlier work concerning a system using no hydrogen absorbing alloy to solve the above mentioned defects. We found that the C.O.P. of the whole system can not be improved if the whole system is only compressed (this system is called vapor compression type in this specification) to carry out the exothermic reaction under a compressed condition. However, the C.O.P. of the whole system can become large if the liquid phase and the gas phase are separated from each other and then each phase is individually compressed.

SUMMARY OF THE INVENTION

Therefore, a first object of the present invention is to provide a simple chemical heat pump system having a large coefficient of performance.

The second object of the present invention is to provide the chemical heat pump system which not only realizes the large coefficient of performance but also realizes excellent durability.

The third object of the present invention is to provide a method to form a chemical heat pump system having a large coefficient of performance and excellent durability by combining known arts.

Above mentioned objects were accomplished by the chemical heat pump system characterized by using a reversible chemical reaction consisting of a decomposition reaction and an addition reaction wherein a gaseous product is formed by said decomposition reaction, and separating the mixture of the gaseous component and the liquid component circulating in the system into a separate gas phase and a separate liquid phase. Then each phase is separately introduced into the addition reaction vessel after separately compressing each phase.

According to the present invention, by separating the mixture into the gas phase and liquid phase, then feeding into the exothermic reaction vessel (addition reaction) after compressing each phase separately, the C.O.P. of the whole chemical heat pump system is remarkably improved.

The chemical heat pump system thus provided by this invention not only shows excellent thermal efficiency but also meets various requirements concerning temperatures of the lower heat source and the higher heat source by choice of the specific chemical reaction system utilized in the chemical heat pump system.

Moreover, in the system provided by the present invention no granular material circulate, therefore the abrasion resistance and durability of the system is excellent.

and (11) are compressors, (13) is an expansion turbine and (20) is an exothermic reaction vessel.

Figure 2:
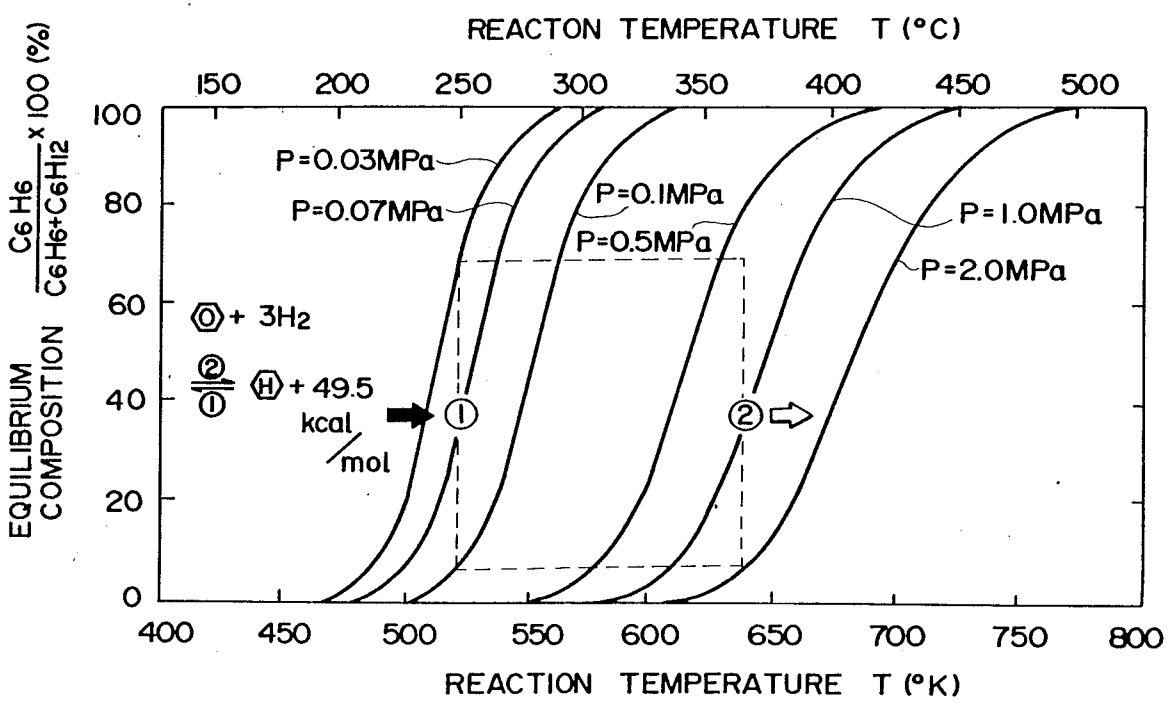

FIG. 2 is a fundamental diagram explaining the a principle of chemical heat pump.

Figure 3:
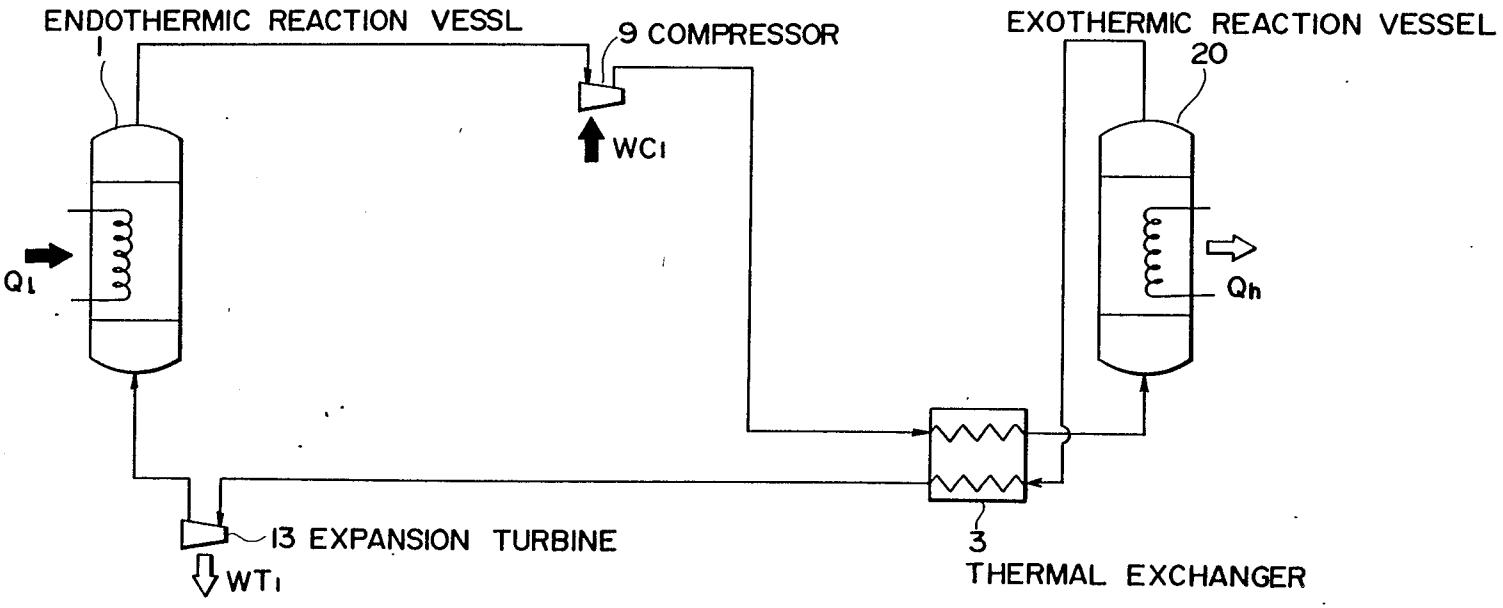

FIG. 3 is a schematic drawing of a vapor compression type chemical heat pump.

Figure 4:
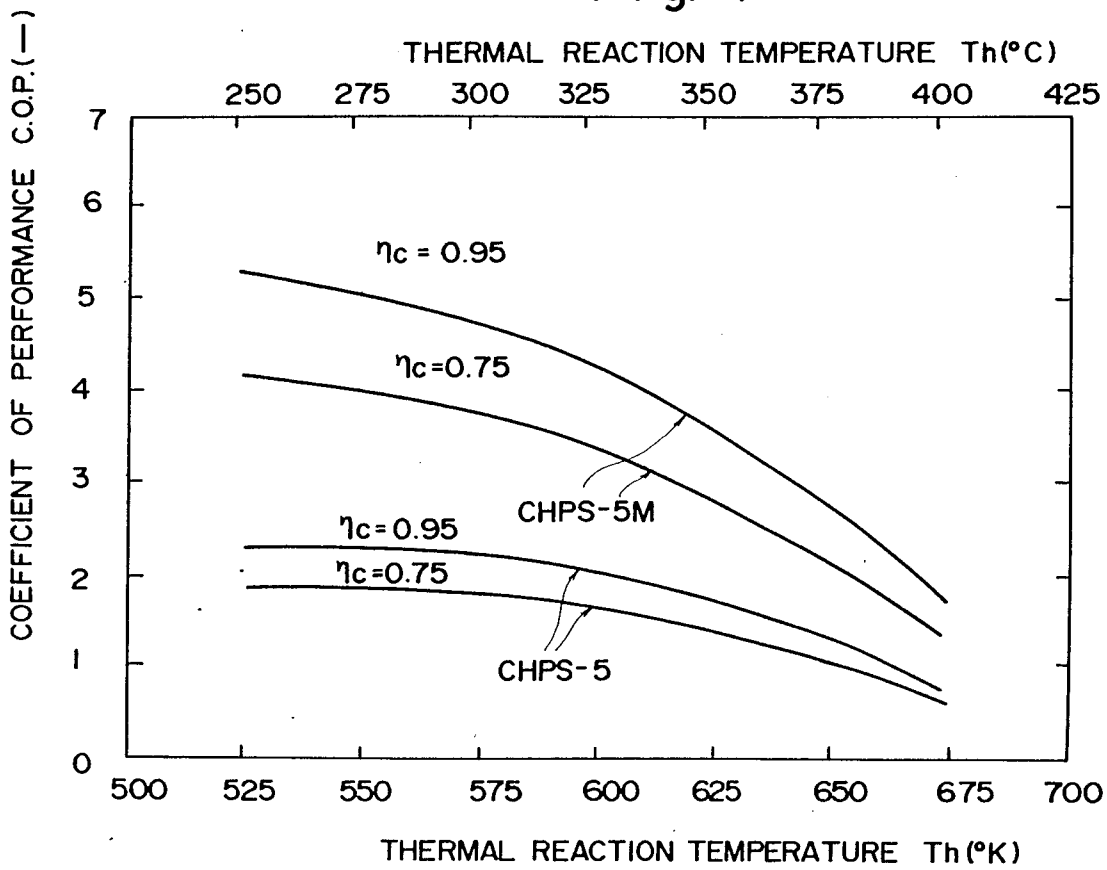

FIG. 4 is a graph showing the relation between temperature caused by an exothermic reaction and the C.O.P. In the drawing, curves shown by CHP-5 are obtained in a vapor compression type system and curves shown by CHPS-5M are obtained in the present invention.

Figure 5:
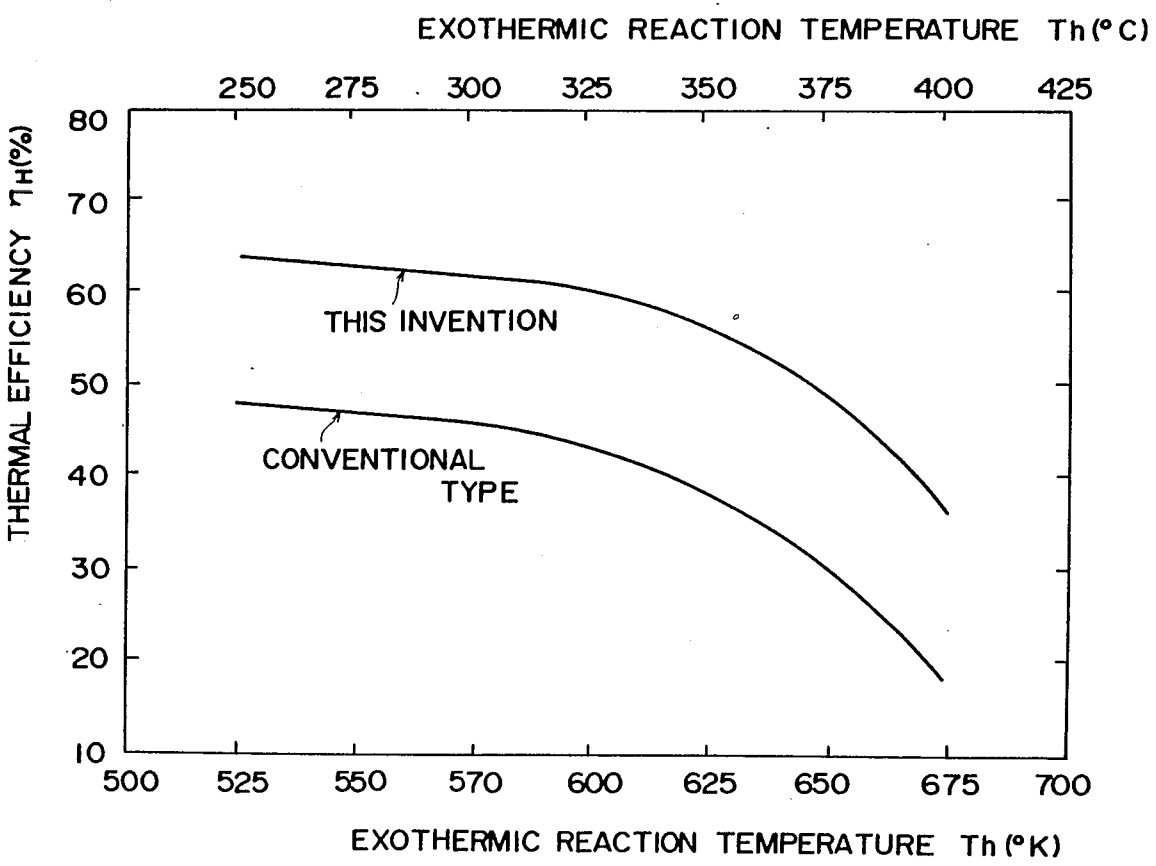

FIG. 5 is a graph showing a relation between a temperature caused by the exothermic reaction and thermal efficiency.

DESCRIPTION OF THE PREFERRED EMBODIMENTS

The reversible decomposition reaction utilized in the present invention involves unimolecular decomposition reaction which produces a gaseous product. Such a decomposition reaction is an endothermic reaction if the products are to exist in safety. In the present invention, the endothermic reaction is carried out in the endothermic reaction vessel and it is necessary to use this reaction to pump the heat energy from the lower heat source.

Namely, the products of the decomposition reaction then should be regenerated to the initial reactant under certain reaction conditions. This regenerating reaction in the present invention is preferably an addition reaction in the gas phase. This addition reaction is generally the exothermic reaction. In the present invention, it is preferable if said addition reaction and the before mentioned decomposition reaction are reversible to each other and if no byproducts are produced which get away from the reversible reaction system.

Therefore, although there are many reaction systems in which the decomposition reaction and the addition reaction occur reversibly, the preferable reaction systems in the present invention are reversible hydrogenation—dehydrogenation reactions.

Some of these reaction systems are reactions utilizing aromatic compounds and cycloalkanes or secondary alcohols and ketones.

Concrete examples of the reaction system utilizing aromatic compound are as follows:

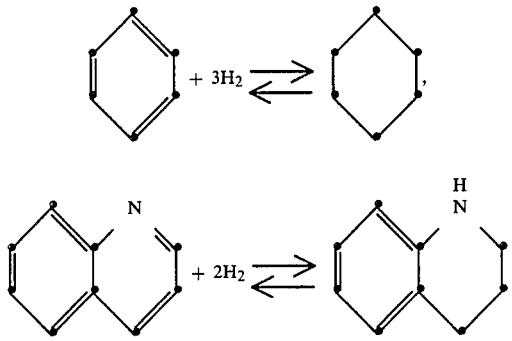

The reaction system utilizing secondary alcohols is expressed by the following equation.

$$R-CHOH-R' \rightleftharpoons R-CO-R' + H_2$$

Temperatures of the lower heat source and the higher heat source of the chemical heat pump system are determined by the absorbed heat quantity and the temperature of the exothermic reaction. Therefore, in the present invention, it is possible to select the reaction and catalyst, if necessary, corresponding to the temperature of the lower heat source and the desired temperature of the higher heat source.

In the above shown reaction, the gas phase mainly consists of the hydrogen but compounds other than the hydrogen form the liquid phase.

In this case, often the gas phase contains vapors of compounds circulating in the chemical heat pump system.

An outline of the principle of the chemical heat pump used in the present invention is herewith described. The example is the case when the benzene-cyclohexane system is utilized.

FIG. 2 shows the relation between an equilibrium composition, which has a parameter of pressure, and reaction temperature in the case of benzene-cyclohexane system. In FIG. 2, curve ① shows that when 10 times the quantity of the hydrogen (a quantity determined by stoichiometry against the benzene) is added, then carring out the gas phase reaction under the reduced pressure of 0.08 MPa (0.81 $Kg/cm^2$), wherein a composition in the reaction system is (benzene/(benzene+cyclohexane))=0.05 at 250° C., the endothermic dehydrogenation reaction of the cyclohexane takes place and the composition ratio becomes to 0.7.

Curve ② shows that when carrying out the gas phase reaction under a pressure of 2.0 MPa (20.89 $Kg/cm^2$), wherein said composition of the reaction system is 0.7, the exothermic hydrogenation reaction of benzene proceeds and the composition becomes 0.05.

Repeating the cycles of processes of ① and ② alternately it is possible to raise the temperature from 250° C. to 367° C. and recover this heat energy, but a compression work (in which the pressure increases from 0.08 MPa to 2.0 MPa) is necessary to realize the above cycle.

According to the drawings, the detail of the present invention will be described below using the benzene-cyclohexane system as an example.

Figure 1:
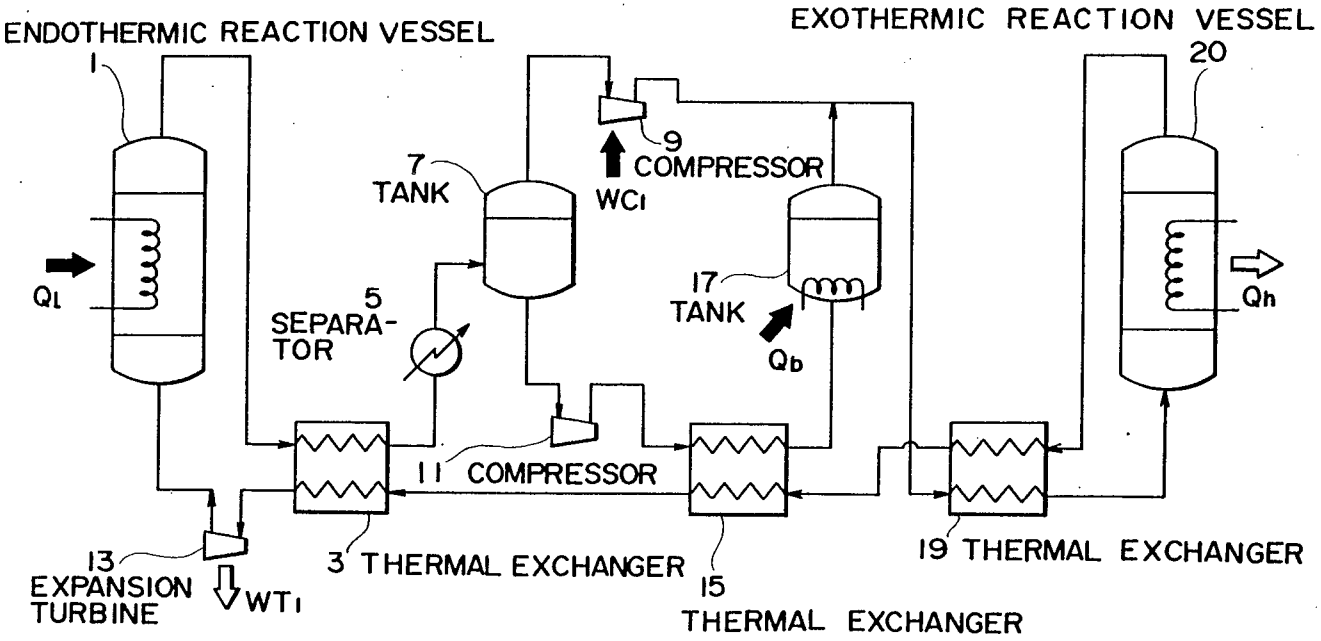
FIG. 1 is a schematic drawing of the chemical heat pump of the present invention. In the drawing, symbol (1) is an endothermic reaction vessel, (5) is a separator to separate a mixture into a gas phase and a liquid phase, (7) is a tank to share materials of both the gas phase and liquid phase, (17) is a tank to save liquid material as well as its vapor, (3), (15) and (19) are heat exchangers, (9)

FIG. 1 is a schematic drawing of the chemical heat pump system of the present invention.

In FIG. 1, symbol (1) means the endothermic reaction vessel which absorbs heat of Ql from outside of the system, as the next decomposition reaction proceeds.

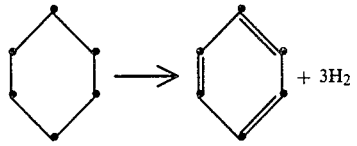

On the other hand, symbol (20) is the exothermic reaction vessel in which the next addition reaction takes place. The heat of Qh generated in the exothermic reaction is there taken out of the system.

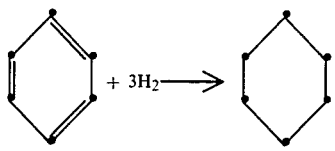

Namely, as is known, if setting up a fixed bed filled with a catalyst (which supports gas phase dehydrogenation catalyst on a carrier) in the endothermic reaction vessel and passing the cyclohexane through the fixed bed under a pressure of 0.009 MPa (0.09 Kg/cm$^2$) under a temperature of 250° C., the dehydrogenation reaction of the cyclohexane proceeds and, therefore benzene and hydrogen are produced.

It is possible to obtain a yield of 70% in this stage. In this endothermic reaction, the reaction system absorbs heat of Ql from outside of the system.

A mixture formed after the reaction arrives at the separator (5) after passing through the heat exchanger (3) and is there separated into the gas phase and the liquid phase, then saved in the tank (7). The gas phase existing in the tank (7) is compressed by the compressor (9) then introduced into the exothermic reaction vessel (20) after passing through the heat exchanger (19). On the other hand, the liquid phase existing in the tank (7) is compressed by the compressor (11) then is introduced into the tank (17) after passing through the heat exchanger (15). After that, the liquid phase is heated to vaporize it and this vapor flows together with above mentioned gas phase on a line which leads to the heat exchanger (19). The gas phase, containing the vapor, is fed into the exothermic reaction vessel after passing through the heat exchanger (19).

The high pressure gas fed into the exothermic reaction vessel 20 causes the exothermic reaction, namely the hydrogenation reaction of benzene progressing in the fixed catalyst bed, contained therein, for example, filled with a catalyst of Ni system then gives off heat energy of Qh. This reaction, for example, reaches to 90% completion when the reaction temperature is 367° C.

After the reaction, the gas mixture is fed back into the endothermic reaction vessel after the recovery of heat energy through the heat exchanger (19), (15) and (3) and after a reduction of pressure by the expansion turbine (13). In this case it is also possible to use a reducing valve instead of the expantion turbine.

In this cycle, the system not only absorbs heat value of Ql from the lower heat source existing outside of the system but also get both work load $WC_1$ to operate the compressor (9) and heat value of Qb to generate vapor pressure (which is at the same pressure as that of the compressed gas) by heating the liquid, then giving off the heat value of Qh to the outside of the system. It is possible to absorb Qb from the lower heat source from outside of the system as same as amount Ql. The amount of heat absorbed in this case depends on the amount of circulation, but it is from about 15% to about 20%. The work load of the compressor (11) is negligible in the present invention since the compressor (11) compresses only liquid and the amount of change of volume is quite small. From the expansion turbine, it is possible to recover the the power of $WT_1$. This power $WT_1$ can be utilized for the work load $WC_1$ performed by the compressor (9).

If the vapor compression type system, which is shown in FIG. 3, is utilized, the mixture of the gas phase and the liquid phase should be compressed, therefore, this system is not preferable because of the following reasons; 1 Some of the vapor may be changed into the liquid by the compression, 2 The electric power consumption to move the compressor may become large, 3 the exothermic reaction may take place in the liquid phase.

Generally, the C.O.P. of the chemical heat pump system is expressed as;

$$C.O.P. = \text{heat power/input work load}$$
$$= Qh/WC_1$$

therefore, the efficiency of the heat pump becomes larger when the input work load becomes smaller.

Namely, it can be understood that by separating a the material (which should be compressed) into the gas phase and the liquid phase, it is possible not only to make the reaction conditions favorable and to save electric power which is used for moving the compressor, but also to make the above mentioned C.O.P. larger—this is what takes place in the present invention. Therefore, it is easy to understand also that the system of the present invention can not only utilize the reversible reaction system of the benzene-cyclohexane but it can also utilize other reversible reaction systems which are accompanied with a generation and an extinction of a gaseous phase.

The best compression ratio should be selected in the present invention so that the C.O.P. should not be lowered, considering the conversion in the exothermic reaction, since the power to operate the compressor increases when the pressure in the exothermic reaction vessel increases.

In the present invention, the means to separate the mixture exiting the endothermic reaction vessel) into the gas phase and the liquid phase can be selected from the well known arts, Condensors are known to be preferable to use as the separator from a view point of the efficiency including an economical cost.

If the difference between a molecular weight of the gas components and that of the liquid components is large, a cheap porous glass and other known membrane means for separation of such materials are also useful as the separator means in the present invention.

EXAMPLES

The following examples are set forth for the purpose of illustration so that those skilled in the art may better understand this invention. They are exemplary only, and should not be construed as limiting the invention in any manner.

EXAMPLE 1

The following two systems are compared each other. One system is the chemical heat pump system of the present invention shown in FIG. 1. The other system is the vapor compression type system (shown in FIG. 3) which can be prepared by eliminating the separator (5), the tanks (7) and (17), the compressor (11), the heat exchangers (15) and (19) from the system of FIG. 1.

When the pressure in the exothermic reaction vessel (20) is 2.0 MPa and the temperature Tl of the lower heat source is 503 K., setting a ratio of $H_2/C_6H_6=1$, the C.O.P. can be calculated using the amount of heat Qh (which is removed from the exothermic reaction vessel)—results are shown in FIG. 4. In the drawing, the curves expressed by CHPS-5 corresponds to the vapor compression system and the curves expressed by CHPS-5M corresponds to the system of the present invention, wherein $\pi c$ is the assumed efficiency of the compressor.

It is clear from FIG. 4 that the C.O.P. in the case of the vapor compression type is less than 3 in all temperature ranges, but in the case of the present invention, the C.O.P. becomes larger than 3 at the range where the exothermic reaction temperature approaches 330° C. when $\pi c=0.75$ and at the range where the exothermic reaction temperature approaches 370° C. when $\pi c=0.95$. From these results, it is seen that the system of the present invention is quite excellent.

EXAMPLE 2

When utilizing the reaction system of hydrogenation—dehydrogenation between isopropyl alcohol and acetone, the vapor compression type system can not function within the chemical heat pump system, since the gaseous acetone changes into the liquid phase when the vapor of the system is compressed after the endothermic reaction. In this case, it was very difficult structurally to heat the gaseous acetone before it is compressed to prevent changing the acetone into the liquid phase. On the other hand the chemical heat pump system of the present invention was able to function using the same IPA-acetone reaction system.

Thus, it is illustrated that when the reaction system in which the gas phase is apt to change into the liquid phase upon compression, the method of the present invention is especially useful.

EXAMPLE 3

Using the conventional system utilizing $LaNi_5H_{6.0}$ as the hydrogen absorbing alloy, the system was moved utilizing the same reaction system and realizing same reaction condition as example 1, then compared with the present invention of example 1.

Defining a thermal efficiency as $\pi H$=heat power/(the quantity of absorbed heat+the quantity of added work), FIG. 5 was obtained. FIG. 5 proves that the present invention is greatly superior to the conventional system from a view point of the thermal efficiency.

What is claimed is:

1. In a chemical heat pump system utilizing a reversible decomposition reaction-addition reaction system wherein a gaseous product is generated in said decomposition reaction in a decomposition vessel (1); an improved chemical heat pump system characterized by separating by separator means (5) the mixture of a gaseous phase component and a liquid phase component from said decomposition reaction into a gas phase, and a liquid phase, then after compression feeding said gas phase and liquid phase into an addition-reaction vessel (20) after separatly compressing each of said phases.

2. The chemical heat pump system as claimed in claim 1, wherein the separation into the gas phase and the liquid phase is carried out by a condensor (5).

3. The chemical heat pump system as claimed in claim 1, wherein the separation into the gas phase and the liquid phase is carried out by a membrane which is used as a separator of materials.

4. The chemical heat pump system as claimed in claims 1 to 3, wherein the chemical reaction system is a reversible hydrogenation reaction-dehydrogenation reaction of aromatic hydrocarbons.

5. The chemical heat pump system as claimed in claim 4, wherein the aromatic hydrocarbon is a benzene.

6. The chemical heat pump system as claimed in claim 4, wherein the aromatic hydrocarbon is a quinoline.

7. The chemical heat pump system as claimed in claims 1 to 3, wherein the chemical reaction system is the reversible hydrogenation reaction-dehydrogenation reaction between a secondary alcohol and a ketone.

8. The chemical heat pump system as claimed in claim 7 wherein said reversible hydrogenation-dehydrogenation reaction is between isopropyl alcohol and acetone.

* * * * *